US005617612A

United States Patent [19]

Ferrari et al.

[11] Patent Number: 5,617,612

[45] Date of Patent: Apr. 8, 1997

[54] SINGLE -PIN FURNITURE HINGE

[75] Inventors: Franco Ferrari, Frazione Deviscio, 2, 22053 Lecco; Carlo Migli, Lecco, both of Italy

[73] Assignee: Franco Ferrari, Italy

[21] Appl. No.: 359,574

[22] Filed: Dec. 20, 1994

[30] Foreign Application Priority Data

Dec. 24, 1993 [IT] Italy ..... MI931007 U

[51] Int. Cl.[6] ..... E05F 1/08

[52] U.S. Cl. ..... 16/278; 16/307

[58] Field of Search ..... 16/278, 277, 287, 16/286, 307, 305, 302, 303, 304, 306, 342, 341, 291, 292, 293, 279, 288, 295, 296, 297, 308

[56] References Cited

U.S. PATENT DOCUMENTS

| | | | |
|---|---|---|---|
| 2,235,984 | 3/1941 | Devereaux | 16/306 |
| 2,272,230 | 2/1942 | Voorhees | 16/306 |
| 3,431,587 | 3/1969 | Beteznak | 16/335 |
| 3,613,151 | 10/1971 | Anderson et al. | 16/278 |
| 3,728,757 | 4/1973 | Lloyd | 16/332 |
| 3,940,828 | 3/1976 | Lautenschlaeger | 16/303 |
| 4,177,540 | 12/1979 | Gorton | 16/335 |
| 4,654,930 | 4/1987 | Lautenschlager | 16/291 |
| 4,675,941 | 6/1987 | Grass | 16/295 |
| 5,027,474 | 7/1991 | Bowers | 16/303 |
| 5,369,841 | 12/1994 | Bembnowski | 16/296 |

FOREIGN PATENT DOCUMENTS

| | | | |
|---|---|---|---|
| 673313 | 6/1952 | United Kingdom | 16/302 |

*Primary Examiner*—M. Rachuba
*Assistant Examiner*—Donald M. Gurley
*Attorney, Agent, or Firm*—Shlesinger, Fitzsimmons & Shlesinger

[57] ABSTRACT

A furniture hinge (10) comprises a first cup-shaped element (11) and a second arm-shaped element (12) pivoted together to rotate reciprocally from an open position to a closed position. The arm-shaped element (12) is made of sheet metal with one end (20) bent to wind round a hinge pin (21) supported in the cup (11). The bent end of the arm-shaped element (12) also defines bearing surfaces (22) for a double twist pressure spring (23) which pushes the first and second element towards the closed position starting from a position close to the latter. A U-bolt forms the hinge pin (21) and a pin (26) supporting the spring.

13 Claims, 4 Drawing Sheets

17
28
29
22
32
20
30
22

135
117
128
129
134
122
120
135
130
122
134

SINGLE -PIN FURNITURE HINGE

BACKGROUND OF THE INVENTION

There are known furniture hinges comprising an arm, to be secured to the side panel of the furniture unit, hinged to a pin internally supporting a cup-shaped element designed to be flush-mounted in the door. Said hinges with a single axis of rotation also comprise a spring-operated mechanism to enable them to reach the completely closed position when they are shifted manually close to said position. In the known technique, the spring-operated mechanism comprises a certain number of parts which interact with each other camwise. For example, there are known spring-operated mechanisms composed of a helical spring which pushes a tappet perpendicularly against a cam integrally secured to the cup or arm. Another type of spring-operated mechanism comprises a cylindrical part integrally secured to one of the two elements of the hinge coaxial to the hinging, which is biased by a leaf spring secured to the other element. The cylindrical surface is provided with a suitably positioned flat faceted area which enables the spring to be released and consequently automatically close the door.

Both types of mechanisms require a relatively expensive preassembling operation to secure the part forming the cam surface to the corresponding hinge element. Alternatively, in order to avoid the preassembling operation, the hinge element can be cast in one piece with the cam, thereby avoid the cost of the preassembling operation. However, this procedure is much more expensive than the conventional procedure of pressing from sheet metal. The useful space for housing the cam and spring inside the hinge is extremely limited. Moreover, the dimensions of the arm and the position of the hinge pin are very often restricted by requirements in terms of size, sturdiness and kinematic movement of the hinge. Consequently, it is difficult to find solutions which are at one and the same time inexpensive and fully satisfactory.

SUMMARY OF THE INVENTION

The general scope of this invention is to obviate the aforementioned problems by providing a hinge of the type with a single pin and spring-operated closure, which can be manufactured with a minimum number of parts and which does not require pre-assembling operations or expensive cast parts.

This scope is achieved, according to the invention, by providing a furniture hinge comprising a first cup-shaped element and a second arm-shaped element pivoted together to rotate reciprocally from an open position to a closed position, the arm-shaped element being made of sheet metal with one end bent to wind around a hinge pin supported in the cup, the arm element being integrally secured to cam means which are biased by at least one pressure spring, between them and the cup, to bias the first and second element towards the closed position starting from a position close to the latter, characterized by the fact that, close to said bent end, the arm-shaped element is shaped with resting surfaces for the spring which form said cam means.

BRIEF DESCRIPTION OF THE DRAWINGS

The innovative principles of this invention and its advantages with respect to the known technique will be more clearly evident from the following description of several possible exemplificative and non restrictive embodiments applying such principles, with reference to the accompanying drawings, in which.

DETAILED DESCRIPTION OF THE INVENTION

Figure 1:
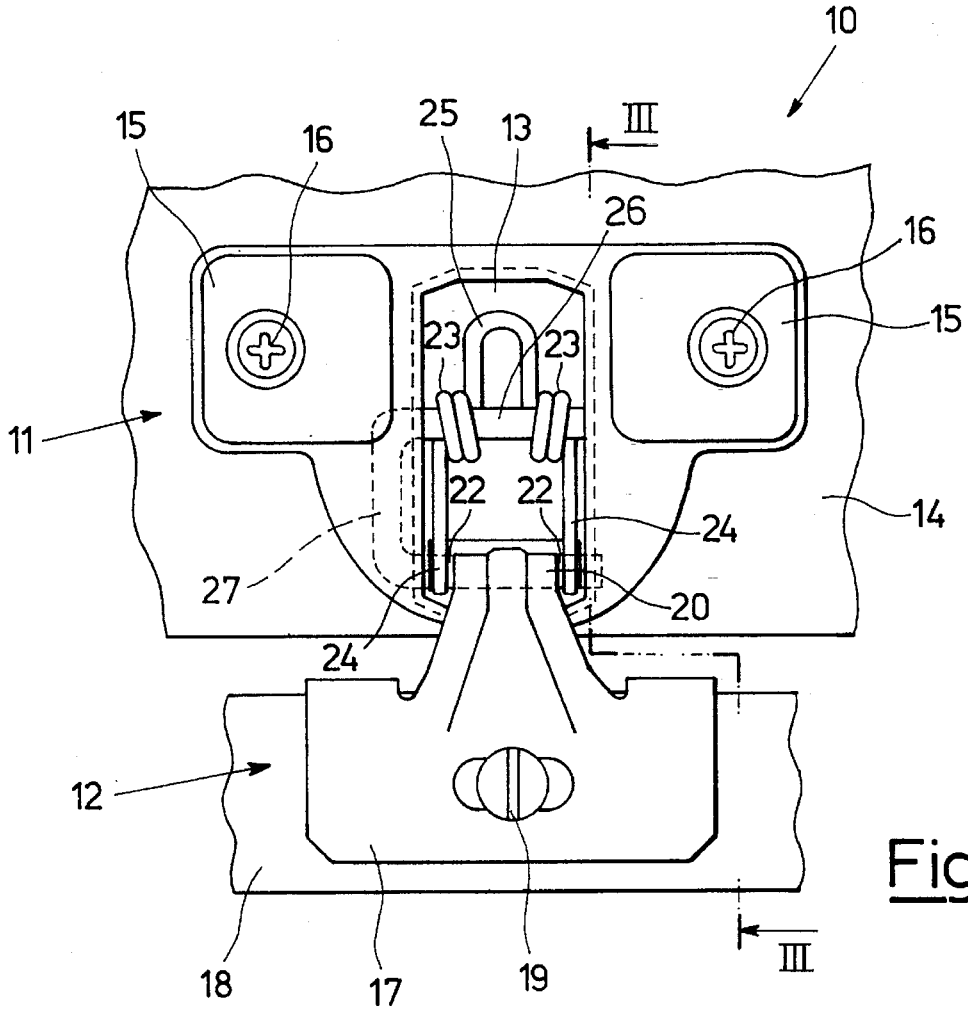
FIG. 1 shows a front view of a first hinge according to the invention, in an open position.
Figure 2:
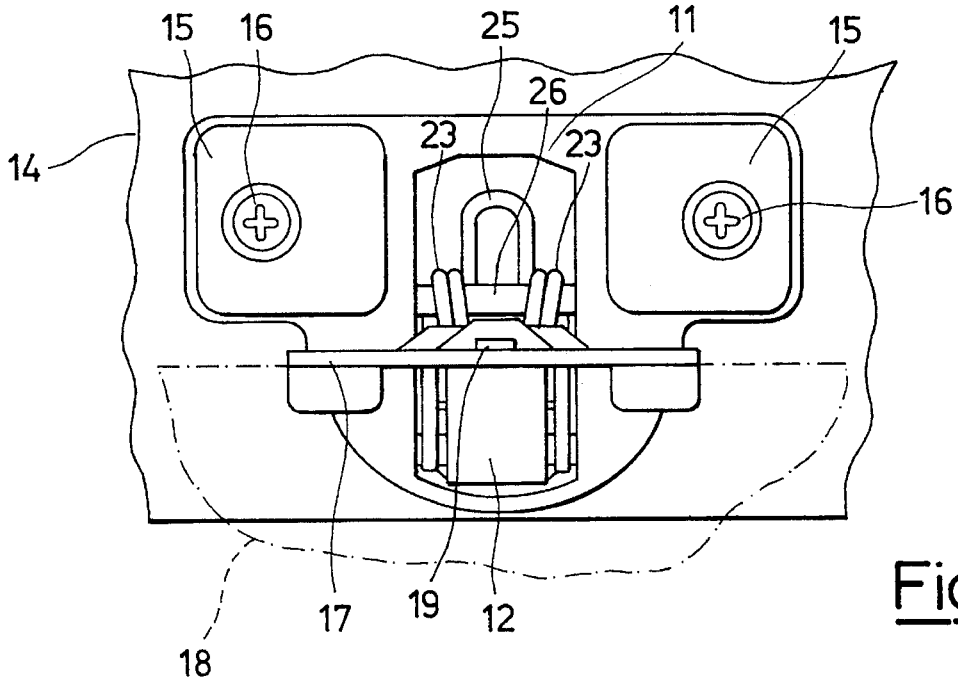
FIG. 2 shows a view similar to that of FIG. 1, but with the hinge in a closed position.
Figure 3:
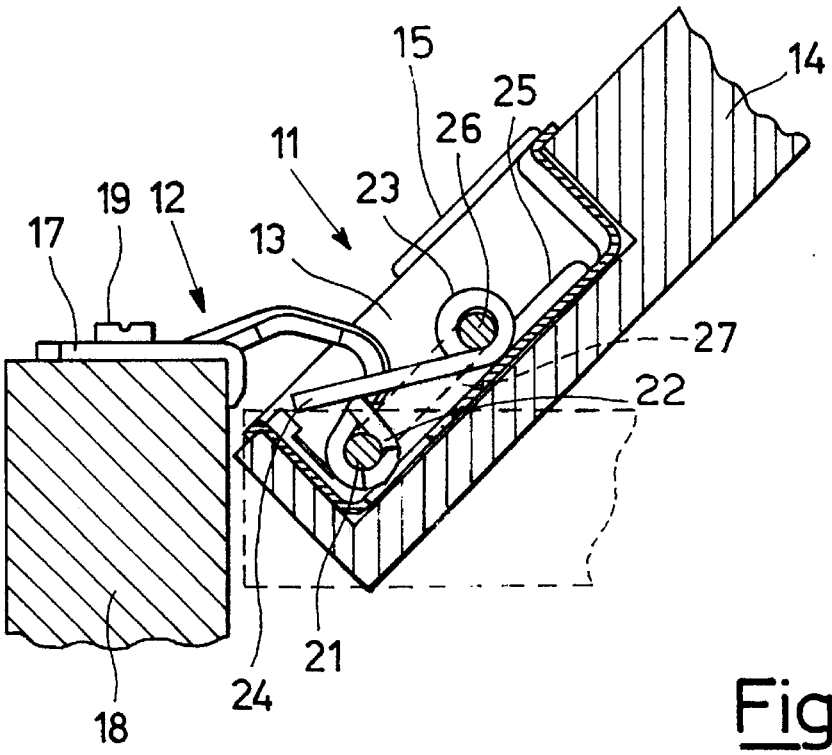
FIG. 3 shows a cross-sectional side view along the line III—III of FIG. 1 of the hinge in an intermediate position.
Figure 4:
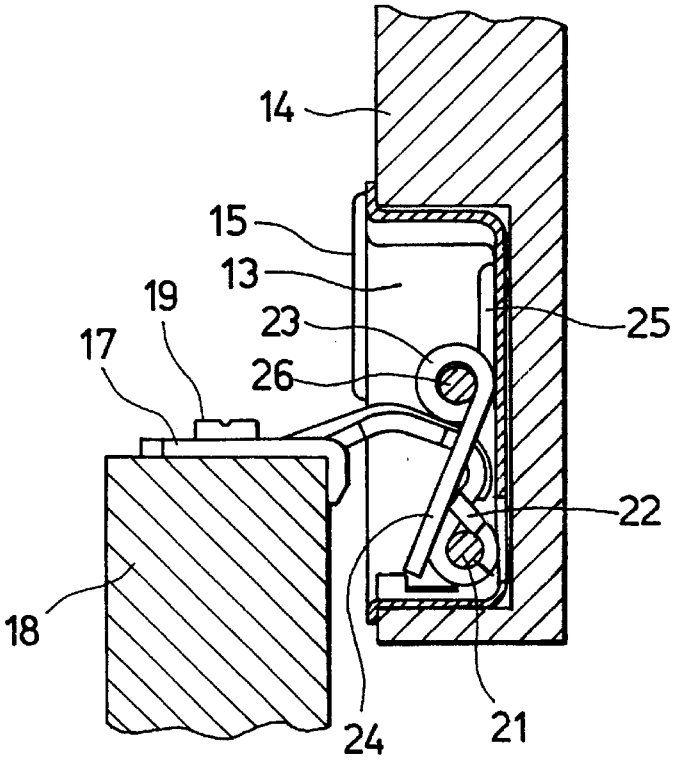
FIG. 4 shows a cutaway view similar to that of FIG. 3, but with the hinge in a closed position.

With reference to the figures, a furniture hinge, generically indicated by reference 10 in FIG. 1, comprises a first cup-shaped element 11 and a second arm-shaped element 12 pivoted together to reciprocally rotate from an open position (shown by the broken line in FIG. 3) to a closed position (shown in FIG. 4). As can be clearly seen in FIG. 3, the cup-shaped element 11, for example made of pressed sheet metal, comprises a hollow central body 13 having therein a central recess or cup, designed to be fitted into a complementary housing made in a door 14, and lateral wings 15 to secure it to the door by means of screws 16. The arm-shaped element, made of pressed sheet metal, has one end 17 folded to enable it to be secured to the corner edge of a side panel 18 of the furniture unit by means of a screw 19. The opposite end 20 of the arm is bent so as to wind round a hinge pin 21 supported in the cup. The arm curves inwards of the cup so as to allow movement between the open position and closed position (shown in FIG. 4) without interference occurring between the door and side panel of the furniture unit.

As can be clearly seen in FIGS. 3 and 4, the bent end 20 also defines spaced resting surfaces 22 for a pressure spring 23. In particular, the resting surfaces 22 are two in number, disposed close to opposing ends of the pin 21, and the spring is of the double-twist type, with free ends 24 each resting on one of said resting surfaces 22 and with a central loop 25 reacting against the bottom of the cup. The double-twist spring 23 has coils wound around a fastening pin 26 supported in the cup parallel to the hinge pin 21. Advantageously, the fastening pin and the hinge pin are parallel arms of a U bolt 27, which simplifies the assembling of the hinge, As can also be clearly seen in FIGS. 3 and 4, the resting surfaces are made from substantially rectilinear extensions 22 of the end 20 of the arm, so that the spring has arms 24 which rest substantially on the free ends of the extensions, laterally to the portion of arm which extends from the pin towards the fastening bracket 17. The position and length of the extensions is such that they act as cam surfaces during the reciprocal rotation of the two hinge elements, releasing the spring when the two elements reach the closed position (FIG. 4) in which the arms of the spring exert pressure on the extensions in order to keep the hinge closed. Upon reciprocal movement of the two elements between the open position and closed position, the free ends of the spring rest, in a point of maximum compression, on the free ends of the extentions. Beyond a certain degree of aperture, the spring has a direction of thrust which passes over the end of the extensions and pushes so as to shift the hinge towards the fully open position.

It is thus possible to obtain cam means which, by means of the spring, bias the first element 11 and second element 12 towards the closed position starting from a position close to the latter. Similarly, the cam means bias the two elements of the hinge towards the fully open position starting from a position close to the latter.

Figure 7:
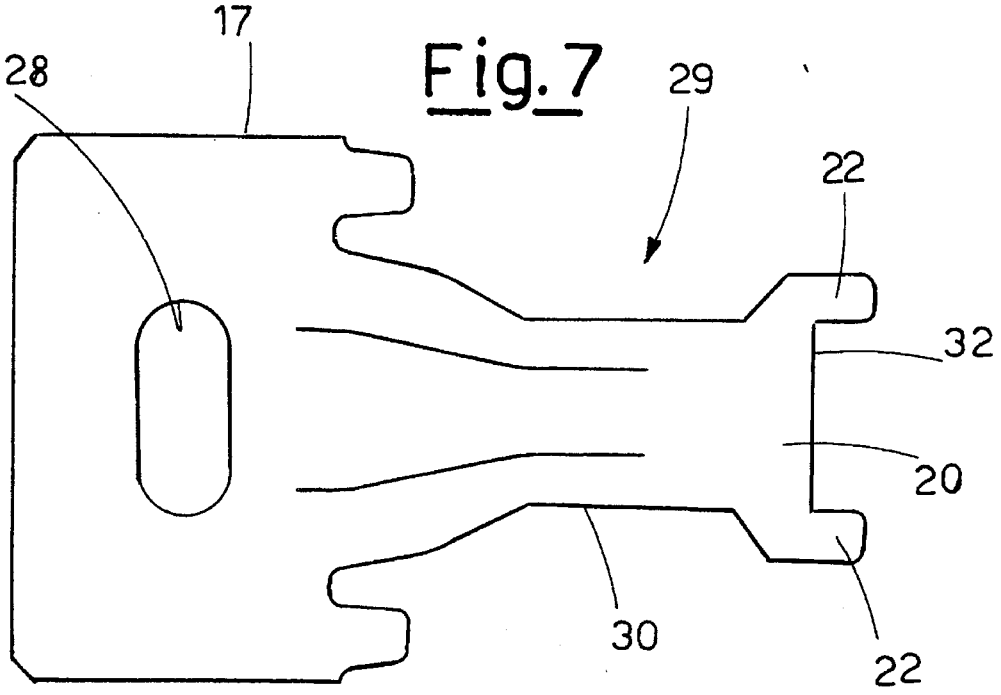
FIGS. 7 and 8 show views of elements made of sheet metal, respectively belonging to the first and second hinge, shown after blanking and before forming.

FIG. 7 shows the flat conformation of the blanked sheet from which the arm 12 is formed by bending. The sheet comprises a widened end portion or fastening plate 17 with a slot 28 which will serve for passage of the screw 19 fastening it to the furniture unit. Extending from the plate 17 is a strip 29 which has an intermediate portion 30 which forms the arm and an end portion 20 designed to be wound around the pin 21. Protruding laterally to the arm, close to the frontal or terminal portion of the end to be wound, are the fingers which define the cams 22. In this embodiment, the fingers also protrude anteriorly to the end 20, so as to define a passage 32 through which the arm 30 will pass after the bend to position the cam surfaces at the sides of the arm and close to the pin (as can be clearly seen in FIG. 3).

At this point it will be obvious that the intended scopes are achieved, by providing a hinge, which is simple and inexpensive to manufacture, having an automatic closing mechanism. The hinge does not require any preassembling operations whatsoever. To fit the hinge it is sufficient to position the arm, cup and spring, insert the U bolt and clinch its free ends.

The foregoing description of an embodiment applying the innovative principles of this invention is obviously given by way of example in order to illustrate such innovative principles and should not therefore be understood as a limitation to the sphere of the invention claimed herein. For example, the means for securing the cup and arm to the respective parts of the furniture unit can be of any type of known technique, as will be clearly obvious to the expert in the field.

It will also be clearly obvious to the expert in the field that the conformation of the extensions forming the cams may differ from the rectilinear conformation shown, even though the rectilinear conformation of the extensions greatly simplifies their manufacture and more easily provides the double action of the spring for automatic opening and closing. Lastly, whenever double action of the spring is not required, the extensions may be made in such a way as to produce maximum pressure of the spring when the hinge is in the fully open position and not in an intermediate position.

Figure 5:
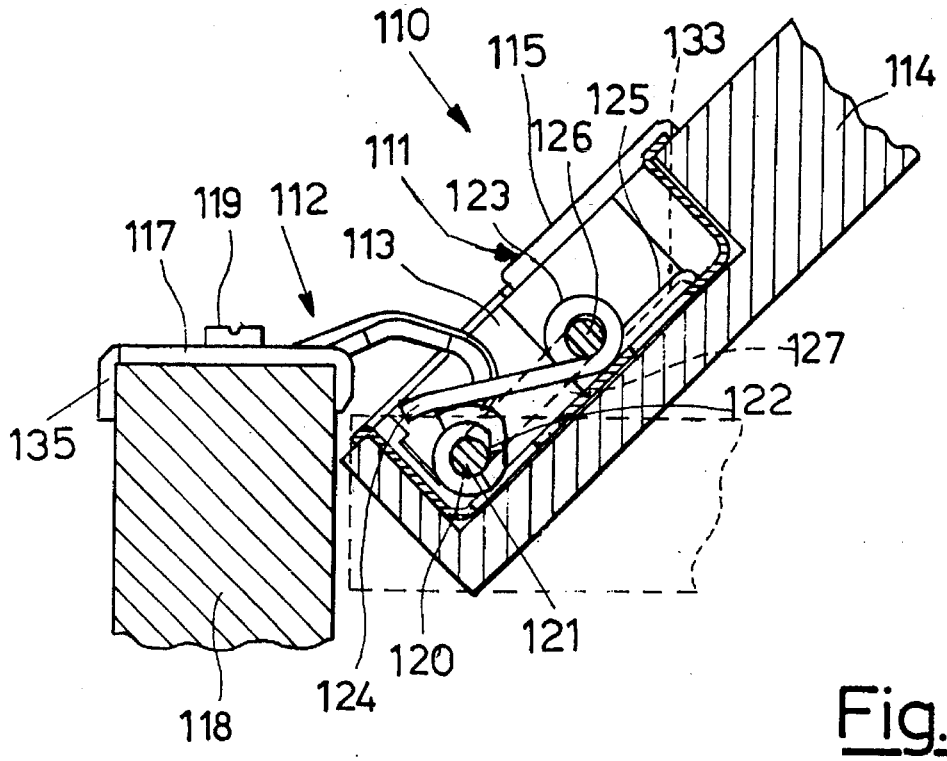
FIGS. 5 and 6 show views, respectively similar to FIGS. 3 and 4, of a second hinge according to the invention.
Figure 6:
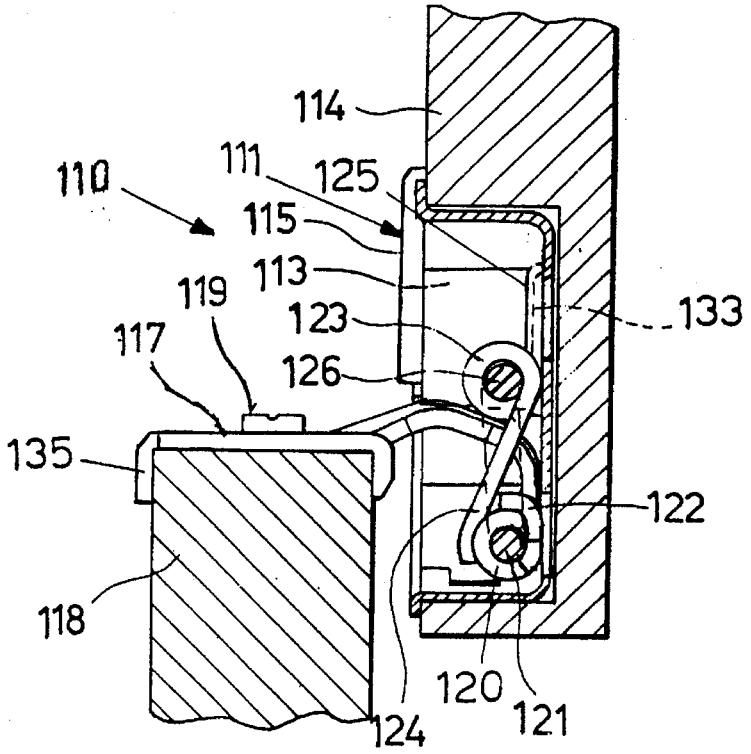
Figure 8:
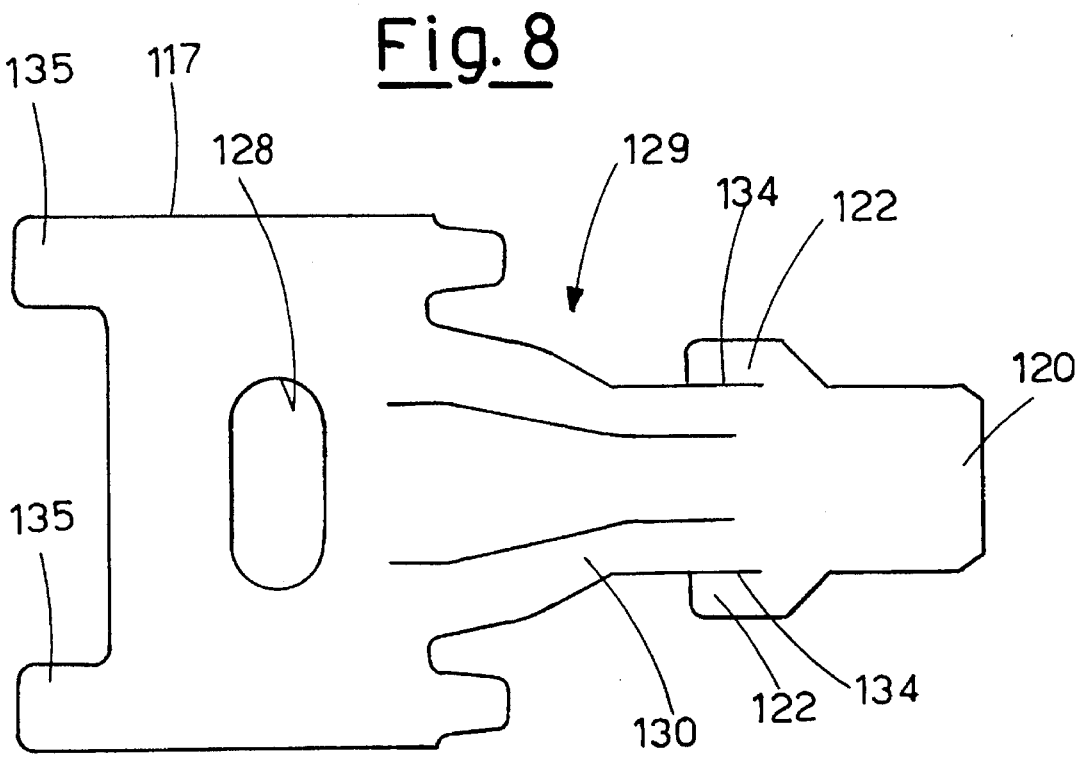

FIGS. 5, 6 and 8 show a second embodiment of a furniture hinge, generically indicated by reference 110, made according to the invention. For the sake of convenience, elements similar to those of the previous embodiment will be indicated with the same number increased by one hundred. Consequently, there is a hinge 110, which comprises a first cup-shaped element 111 and a second arm-shaped element 112 pivoted together to rotate reciprocally from an open position (shown by the broken line in FIG. 5) to a closed position (shown in FIG. 6). As can be clearly seen in FIG. 5, the cup-shaped element 111, for example made of pressed sheet metal, comprises a hollow central body 113 having therein a central recess or cup, designed to be fitted into a complementary housing made in a door 114, and lateral wings 115 to secure it by means of screws, The arm-shaped element, made of pressed sheet metal, has one end 117 folded to enable it to be secured to the corner edge of a side panel 118 of the furniture unit by means of a screw 119. The opposite end 120 of the arm is bent so as to wind round a hinge pin 121 supported in the cup.

The arm curves inwards so as to allow movement between the open position and closed position without interference occurring between the door and side panel of the furniture unit.

The bent end 120 also defines cam means in the form of a pair of laterally spaced fingers forming cam or resting surfaces 122 for free arms 124 of a pressure spring 123, of the double-twist type, with a central loop 125 reacting against the bottom of the cup. The double-twist spring 123 (similar to the spring 23 shown in FIG. 1) has coils wound round a fastening pin 126 supported in the cup parallelly to the hinge pin 121. Advantageously, the fastening pin and the hinge pin are parallel arms of a U bolt 127, which simplifies the assembling of the hinge. To ensure better fastening of the spring, the bottom of the cup can have a funnel-shaped or raised portion 133 which is surrounded by the loop 125 of the spring.

The end of the arm is wound around the pin 121 in the opposite direction to the previous embodiment (in a clockwise direction, as can be seen in FIG. 5) and the cam surfaces 122 close to the sides of the pin are curved to define a curved resting surface for the spring when the hinge is in the open position (as can be seen in FIG. 5), and resting end for the spring when the hinge is in the closed position (as can be seen in FIG. 6). The curved surfaces can be curved to a degree that the spring arms 124 remain the same radial distance from pin 120, so that the spring is compressed but does not exert action at least along a section of the distance it slides over the curved surfaces.

The spring is released when its arm pass over the free ends of the cam surfaces 122. In this way, the spring biases the hinge towards the closed position shown in FIG. 6 when the hinge is close to the latter, and once it has reached the closed position, it keeps it closed. FIG. 8 shows a flat blanked metal sheet from which the arm 112 is formed by bending. The sheet comprises a widened end portion or fastening plate 117 with a slot 128 which will serve for passage of the screw 119 fastening it to the furniture unit. Extending from the plate 117 is a strip 129 which has an intermediate portion 130 which forms the arm and an end portion 120 designed to be wound around the pin 121. Protruding laterally from the arm, close to the initial portion of the end to be wound, are the fingers which form the cams 122. In this embodiment, the fingers protrude only laterally, disposed between the intermediate portion of arm and the end portion that is to be wound on the hinge pin and have slits 134 so that the fingers run substantially parallel to the median plane of the arm but in the opposite direction to the bent end of the arm and so as to be able to be curved according to the conformation shown in FIGS. 5 and 6.

As can be noted by the figures of both embodiments, by placing the cam forming fingers at the side of the arm (both at the end of the wound portion, as in FIG. 7, and at the beginning of said portion as in FIG. 8) with the median planes thereof extending parallel to the median plane of the arm, and transverse to the axis of the associated hinge pin, it is possible to obtain an arm which is extremely sturdy, especially in the winding area, which is of critical importance for the strength of the hinge. At the same time, the with of the arm in the wound area is-narrow enough to enable the pin to be placed very close to the wall of the cup, which is important to ensure a correct opening and closing movement. The arms of the spring and the cam surfaces occupy areas to the side of the arm of the hinge which are usually not used, thereby eliminating excessive additional encumbrance.

The springs used can obviously be either a single double-twist spring, or a pair of springs each with one end reacting on the cup and one end reacting on one of the two cam surfaces.

The part 17, 117 for securing the hinge to the furniture unit can differ from the one shown, according to the known technique. For example, both embodiments can be devoid of rear fastening wings (FIG. 3) or comprise them (FIG. 5, and FIG. 8 at 135).

What is claimed is:

1. Furniture hinge comprising a first, cup-shaped element and a second, arm-shaped element pivoted together to enable said cup-shaped element to rotate reciprocally from an open position to a closed position, said cup-shaped element having therein a recessed cup and a hinge pin secured therein adjacent the bottom of said cup, and the arm-shaped element being made of one piece of sheet metal with at least a portion of one end thereof bent to wind around said hinge pin adjacent the bottom of said cup, a pressure spring means mounted in said cup adjacent said hinge pin, the arm-shaped element having thereon cam means which are engaged by said pressure spring means to bias the first and second elements towards the closed position starting from a position close to the latter, and characterized by the fact that, adjacent to said bent end thereof, the arm-shaped element is shaped to form thereon said cam means which comprises a plurality of spaced resting surfaces engaged by the spring means, said resting surfaces being formed on spaced fingers which extend laterally from opposite side edges of the bent arm-shaped element and overlie said hinge pin.

2. Hinge as claimed in claim 1, characterized by the fact that the spaced resting surfaces are two in number and are located one each adjacent opposite sides, respectively, of the arm-shaped element so as to be disposed close to the opposing ends of the hinge pin, and the spring means having one of two free ends thereof resting Ion a corresponding one of said resting surfaces and reacting against the cup.

3. Hinge as claimed in claim 2, characterized by the fact that the spring means has coils winding around a fastening pin supported in the cup parallel to the hinge pin.

4. Hinge as claimed in claim 3, characterized by the fact that the fastening pin and hinge pin comprise parallel arms of a U bolt.

5. Hinge as claimed in claim 2, characterized by the fact that each resting surface has a curved area on which the respective free end of the spring means rests when the hinge is in a position close to the open position.

6. Hinge as claimed in claim 5, characterized by the fact that the curved area has a curvature of such degree that the free ends of the spring remain the same radial distance from the hinge pin, so that the spring means does not carry out any substantial work during the movement of the hinge with the spring means in contact with said curved area.

7. Hinge as claimed in claim 2, characterized by the fact that the spring means is a double-twist spring having two free ends and a central loop, each free end resting on one of the two resting surfaces and the central loop reacting against the bottom of the cup.

8. Hinge as claimed in claim 7, characterized by the fact that in the movement thereof between the open and closed position the arm-shaped element passes between the two free ends of the double-twist spring.

9. Hinge as claimed in claim 2, characterized by the fact that the median plane of each of said fingers extends parallel to the median plane of the arm-shaped element.

10. Hinge as claimed in claim 9, characterized by the fact that upon reciprocal movement of the first and second element between the open position and the closed position, the free ends of the spring means rest on free ends of the fingers.

11. Hinge as claimed in claim 9, characterized by the fact that the fingers protrude from a frontal portion of the bent end of the arm-shaped element.

12. Hinge as claimed in claim 9, characterized by the fact that the fingers protrude from an initial portion adjacent the beginning of the bent end of the arm shaped element and are directed in the opposite direction to the terminal portion of the bent end.

13. Hinge as claimed in claim 1, characterized by the fact that the spring means exerts pressure on the resting surfaces to also bias the first and second element towards the open position starting from a position close to the latter.

* * * * *

US005617612C1

(12) EX PARTE REEXAMINATION CERTIFICATE (5463rd)

United States Patent
Ferrari et al.

(10) Number: US 5,617,612 C1
(45) Certificate Issued: Aug. 1, 2006

(54) SINGLE-PIN FURNITURE HINGE

(75) Inventors: Franco Ferrari, Frazione Deviscio, 2, 22053 Lecco (IT); Carlo Migli, Lecco (IT)

(73) Assignee: Franco Ferrari, Lecco (IT)

Reexamination Request:
No. 90/006,916, Jan. 20, 2004

Reexamination Certificate for:

| | |
|---|---|
| Patent No.: | **5,617,612** |
| Issued: | **Apr. 8, 1997** |
| Appl. No.: | **08/359,574** |
| Filed: | **Dec. 20, 1994** |

(30) Foreign Application Priority Data

Dec. 24, 1993 (IT) ..... MI931007 U

(51) Int. Cl.
*E05F 1/08* (2006.01)

(52) U.S. Cl. ..... 16/278; 16/307
(58) Field of Classification Search ..... None
See application file for complete search history.

(56) References Cited

U.S. PATENT DOCUMENTS 5,369,841 A 12/1994 Bembnowski ..... 16/278

FOREIGN PATENT DOCUMENTS

| | | |
|---|---|---|
| DE | 32 18 804 | 5/1982 |
| DE | 36 01 682 | 7/1987 |
| IT | 614 782 | 1/1961 |

*Primary Examiner*—Chuck Y. Mah

(57) ABSTRACT

A furniture hinge (10) comprises a first cup-shaped element (11) and a second arm-shaped element (12) pivoted together to rotate reciprocally from an open position to a closed position. The arm-shaped element (12) is made of sheet metal with one end (20) bent to wind round a hinge pin (21) supported in the cup (11). The bent end of the arm-shaped element (12) also defines bearing surfaces (22) for a double twist pressure spring (23) which pushes the first and second element towards the closed position starting from a position close to the latter. A U-bolt forms the hinge pin (21) and a pin (26) supporting the spring.

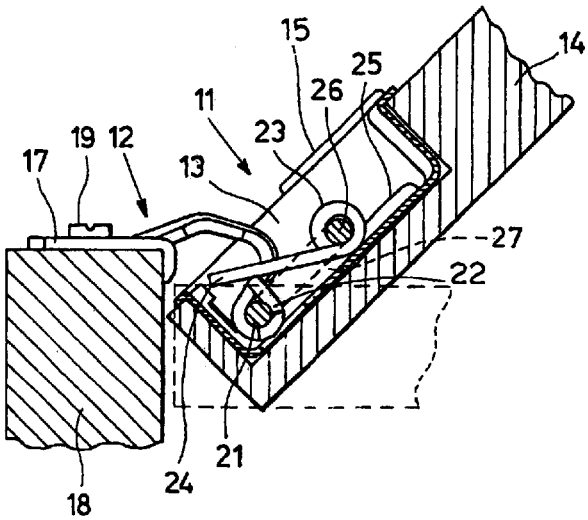

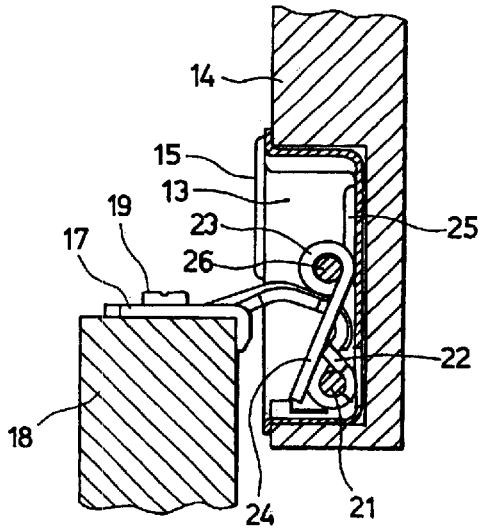

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *